US008016959B2

(12) United States Patent
Hagel et al.

(10) Patent No.: US 8,016,959 B2
(45) Date of Patent: Sep. 13, 2011

(54) THERMAL PRE-IGNITION AGENTS

(75) Inventors: Rainer Hagel, Erlangen (DE); Ulrich Bley, Furth (DE)

(73) Assignee: Ruag Ammotec GmbH, Furth (DE)

( * ) Notice: Subject to any disclaimer, the term of this patent is extended or adjusted under 35 U.S.C. 154(b) by 356 days.

(21) Appl. No.: 10/583,510

(22) PCT Filed: Dec. 7, 2004

(86) PCT No.: PCT/EP2004/013899

§ 371 (c)(1),
(2), (4) Date: Jun. 15, 2007

(87) PCT Pub. No.: WO2005/058775

PCT Pub. Date: Jun. 30, 2005

(65) Prior Publication Data

US 2008/0043385 A1 Feb. 21, 2008

(30) Foreign Application Priority Data

Dec. 17, 2003 (DE) ..... 103 59 536
Sep. 22, 2004 (DE) ..... 10 2004 045 900

(51) Int. Cl.
*C06B 25/00* (2006.01)
*C06B 25/34* (2006.01)
*C06B 25/04* (2006.01)
*D03D 23/00* (2006.01)
*D03D 43/00* (2006.01)

(52) U.S. Cl. ..... 149/88; 149/92; 149/105; 149/108.6; 149/109.2; 149/109.4

(58) Field of Classification Search ..... 149/88, 149/109.4, 92, 105, 108.6, 109.2
See application file for complete search history.

(56) References Cited

U.S. PATENT DOCUMENTS

| | | | | |
|---|---|---|---|---|
| 1,935,495 | A | 11/1933 | Young | |
| 3,320,882 | A | 5/1967 | Schulz | |
| 3,734,476 | A * | 5/1973 | Holzman | 266/48 |
| 4,379,007 | A * | 4/1983 | Fifer et al. | 149/22 |

FOREIGN PATENT DOCUMENTS

EP 0 665 138 A 8/1995

OTHER PUBLICATIONS

Clark, Ind. End. Chem., 1993, 25 (12), 1384-1390.*
Clark, Analogs of Tetryl, Hexanitrodiphenylaminoethyl Nitrate, Industrial & Engineering Chemistry, vol. 26, 1934, XP002326180.
International Search Report of PCT/EP2004/013899.

* cited by examiner

*Primary Examiner* — James E McDonough
(74) *Attorney, Agent, or Firm* — Antonelli, Terry, Stout & Kraus, LLP.

(57) ABSTRACT

The invention relates to thermal pre-ignition agents and to their use as thermal fuses, in particular for use in gas generators of motor-vehicle safety systems.

29 Claims, No Drawings

THERMAL PRE-IGNITION AGENTS

The present invention provides pre-ignition agents which can be used, for example, as thermal fuses in gas generators for motor vehicle safety systems.

Thermal pre-ignition agents are pyrotechnic substances or mixtures. They have the function, inter alia, of igniting the gas-producing mixtures of the gas generator, which generally have very high thermal stability, in a controlled manner in the event of a vehicle fire.

There are used as thermal pre-ignition agents, for example, nitrocellulose, propellant-charge powders derived therefrom, or the mixtures based on nitrotriazolone and guanidine nitrate described in patent application DE 197 30 873 A1. These mixtures have ignition temperatures of approximately 160° C. and, in the case of nitrocellulose, have only inadequate long-term stability.

The object of the present invention was to provide pyrotechnic mixtures having ignition temperatures of about 200° C. and adequate long-term stability, which mixtures can be used as thermal pre-ignition agents for gas generators in motor vehicle safety systems. The object underlying the invention has been achieved by the use of 2-[bis-(2,4,6-trinitrophenyl)]aminoethyl nitrate, abbreviated to dipicrylaminoethyl nitrate (DPN). This substance can be used either on its own or in mixtures with further components. DPN can be prepared from 2,4-dinitrochlorobenzene and ethanolamine with subsequent nitration (lit.: R. V. Clark, Ind. Eng. Chem., 25, 1385 (1933)). The structural formula is as follows:

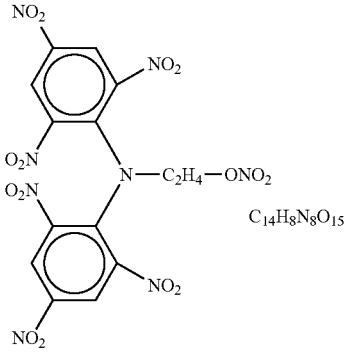

The deflagration point of pure DPN is at about 200° C. Surprisingly, it has been found that, in mixtures of DPN with selected components as additives, the deflagration point can be controlled in the range from 178° C. to 208° C., and the deflagration temperatures of the mixtures may be lower than those of the individual components. For pre-ignition agents, deflagration temperatures below 200° C. are of particular interest. The mixtures according to the invention meet this demand, while having excellent long-term stability.

There can be used as additives:

1. Nitrogen-containing compounds (on their own or in mixtures)
   nitroguanidine, nitroaminoguanidine, nitrotriazolone, derivatives of tetrazole, such as 5-aminotetrazole, ditetrazolylamine, ditetrazole and salts thereof, nitraminotetrazole and its salts, such as ammonium nitraminotetrazole and aminoguanidinium nitramino-tetrazole, aminoguanidine nitrate, diaminoguanidine nitrate, triaminoguanidine nitrate, guanidine nitrate, dicyandiamidine nitrate, diaminoguanidine azotetrazolate.
2. Oxidising agents (on their own or in mixtures)
   nitrates of the alkali or alkaline earth metals or of ammonium such as sodium nitrate or potassium nitrate, perchlorates of the alkali or alkaline earth metals or of ammonium, peroxides of the alkaline earth metals or of zinc.
3. Reducing agents (on their own or in mixtures)
   aluminium, titanium, titanium hydride, boron, boron hydride, zirconium, zirconium hydride, silicon, graphite, activated carbon, carbon black.
4. Binders (on their own or in mixtures)
   cellulose and derivatives thereof, polyvinylbutyrals, polynitropolyphenylene, polynitrophenyl ether, Plexigum, polyvinyl acetate and copolymers.
5. High-energy additives (on their own or in mixtures)
   hexogen, octogen and nitrocellulose.
6. Combustion moderators and processing aids (on their own or in mixtures)
   ferrocene and derivatives, acetonylacetates, salicylates, silicates, silica gels, boron nitride.

Production and processing are carried out according to known and conventional processes. These include, for example, kneading, extrusion, extrusion moulding, pelleting or granulation.

The Examples which follow are intended to illustrate the invention in greater detail without limiting it.

Table 1 shows the compositions of twelve different mixtures. The components were weighed in the indicated weight ratios (amounts are in percent by weight (wt. %)) into plastics beakers and homogenised for 30 minutes in a tumbler mixer.

TABLE 1

| | Examples | | | | | | |
|---|---|---|---|---|---|---|---|
| Mixture | DPN in wt. % | Nitroguanidine in wt. % | 5-Amino-tetrazole in wt. % | Guanidine nitrate in wt. % | Potassium nitrate in wt. % | Sodium nitrate in wt. % | Potassium perchlorate in wt. % |
| 1 | 50 | | | | 50 | | |
| 2 | 50 | | | | | 50 | |
| 3 | 50 | | | | | | 50 |
| 4 | 20 | 30 | | | 50 | | |
| 5 | 20 | 30 | | | | 50 | |
| 6 | 20 | 30 | | | | | 50 |
| 7 | 20 | | 30 | | 50 | | |
| 8 | 20 | | 30 | | | 50 | |
| 9 | 20 | | 30 | | | | 50 |
| 10 | 20 | | | 30 | 50 | | |
| 11 | 20 | | | 30 | | 50 | |
| 12 | 20 | | | 30 | | | 50 |

Table 2 shows the heat of explosion of the mixtures and their friction and impact sensitivity. The friction and impact sensitivity was measured according to methods of the Bundesanstalt für Materialforschung [Federal Institute of Materials Research] (BAM), while the heat of explosion was measured using a calorimeter from EKA.

TABLE 2

Overview of the heat of explosion and friction and impact sensitivity

| Mixture | Heat of explosion in J/g | Friction sensitivity in N | Impact sensitivity in J |
|---|---|---|---|
| 1 | 4859 | 240 | 6 |
| 2 | 3280 | 240 | 7.5 |
| 3 | 5915 | 120 | 5 |
| 4 | 5157 | 360 | 7.5 |
| 5 | 3125 | 120 | >30 |
| 6 | 5523 | 80 | 10 |
| 7 | 4014 | 240 | 6 |
| 8 | 3187 | 360 | 15 |
| 9 | 5056 | 80 | 6 |
| 10 | 4509 | 360 | 7.5 |
| 11 | 3484 | 360 | 10 |
| 12 | 5115 | 160 | 10 |

Table 3 summarises the deflagration points before and after exposure to heat (400 h, 110° C.) and the weight losses after exposure to heat for 72 hours and 400 hours at 110° C. The deflagration points were determined by thermogravimetric analysis (Mettler) at a rate of heating of 10° C. per minute. The weight loss was measured analogously to the Holland test.

After 400 hours, only slight weight losses of from 0.2 to 0.5 wt. % are found, and there is no significant change in the deflagration temperature after exposure to heat.

TABLE 3

Overview of weight losses and deflagration temperatures

| Mixture | Weight loss 72 h 110° C. in wt. % | Weight loss 400 h 110° C. in wt. % | Deflagration temperature in ° C. | Deflagration temperature after 400 h, 110° C. in ° C. |
|---|---|---|---|---|
| 1 | 0.11 | 0.27 | 203 | 202 |
| 2 | 0.15 | 0.35 | 203 | 203 |
| 3 | 0.12 | 0.29 | 201 | 201 |
| 4 | 0.11 | 0.49 | 207 | 206 |
| 5 | 0.16 | 0.53 | 196 | 194 |
| 6 | 0.11 | 0.49 | 201 | 202 |
| 7 | 0.10 | 0.44 | 196 | 200 |
| 8 | 0.11 | 0.42 | 178 | 184 |
| 9 | 0.11 | 0.42 | 196 | 198 |
| 10 | 0.09 | 0.18 | 205 | 205 |
| 11 | 0.12 | 0.26 | 206 | 208 |
| 12 | 0.11 | 0.31 | 205 | 205 |

The Examples show that the mixtures defined according to the invention have deflagration temperatures in the range from 178 to 208° C. and are to be regarded as stable according to the requirements of the automotive industry.

The present invention specifically provides:

Thermal pre-ignition agents which contain as a component dipicrylaminoethyl nitrate (DPN) in amounts by weight of from 10 to 100%.

Thermal pre-ignition agents which, in addition to DPN, contain nitrogen-containing compounds, on their own or in mixtures, in amounts by weight of from 0 to 90%, such as, for example, nitroguanidine, nitroaminoguanidine, nitrotriazolone, derivatives of tetrazole, such as 5-aminotetrazole, ditetrazolylamine, ditetrazole and salts thereof, nitraminotetrazole and its salts, such as ammonium nitraminotetrazole and aminoguanidinium nitraminotetrazole, aminoguanidine nitrate, diaminoguanidine nitrate, triaminoguanidine nitrate, guanidine nitrate, dicyandiamidine nitrate, diaminoguanidine azotetrazolate.

Thermal pre-ignition agents which, in addition to DPN and the above-mentioned nitrogen-containing compounds, on their own or in mixtures, contain oxidising agents, on their own or in mixtures, in amounts by weight of from 10 to 90%, such as, for example, nitrates of the alkali or alkaline earth metals or of ammonium, such as sodium nitrate or potassium nitrate, perchlorates of the alkali or alkaline earth metals or of ammonium, peroxides of the alkaline earth metals or of zinc.

Thermal pre-ignition agents which, in addition to DPN, the above-mentioned nitrogen-containing compounds, on their own or in mixtures, and/or the above-mentioned oxidising agents, on their own or in mixtures, contain reducing agents, on their own or in mixtures, in amounts by weight of from 1 to 80%, such as, for example, aluminium, titanium, titanium hydride, boron, boron hydride, zirconium, zirconium hydride, silicon, graphite, activated carbon, carbon black.

Thermal pre-ignition agents which, in addition to DPN, the above-mentioned nitrogen-containing compounds, on their own or in mixtures, the above-mentioned oxidising agents, on their own or in mixtures, and/or the above-mentioned reducing agents, on their own or in mixtures, contain binders, on their own or in mixtures, in amounts by weight of from 1 to 80%, such as, for example, cellulose and derivatives thereof, polyvinylbutyrals, polynitropolyphenylene, polynitrophenyl ether, Plexigum, polyvinyl acetate and copolymers.

Thermal pre-ignition agents which, in addition to DPN, the above-mentioned nitrogen-containing compounds, on their own or in mixtures, the above-mentioned oxidising agents, on their own or in mixtures, the above-mentioned reducing agents, on their own or in mixtures, and/or the above-mentioned binders, on their own or in mixtures, contain high-energy additives, on their own or in mixtures, in amounts by weight of from 10 to 80%, such as, for example, hexogen, octogen and nitrocellulose.

Thermal pre-ignition agents which, in addition to DPN, the above-mentioned nitrogen-containing compounds, on their own or in mixtures, the above-mentioned oxidising agents, on their own or in mixtures, the above-mentioned reducing agents, on their own or in mixtures, the above-mentioned binders, on their own or in mixtures, and/or the above-mentioned high-energy additives, on their own or in mixtures, contain combustion moderators and processing aids, on their own or in mixtures, in amounts by weight of from 0.1 to 20%, such as, for example, ferrocene and derivatives, acetonylacetates, salicylates, silicates, silica gels, boron nitride.

Thus, the thermal pre-ignition agents may contain from 10 to 90 wt. %, preferably from 25 to 75 wt. %, particularly preferably from 40 to 60 wt. %, dipicrylaminoethyl nitrate and from 10 to 90 wt. %, preferably from 25 to 75 wt. %, particularly preferably from 40 to 60 wt. %, of an oxidizing agent. The thermal pre-ignition agents may contain from 10 to 90 wt. %, preferably from 10 to 50 wt. %, particularly preferably from 10 to 30 wt. %, dipicrylaminoethyl nitrate, from 10 to 90 wt. %, preferably from 10 to 60 wt. %, particularly preferably from 20 to 40 wt. %, of a nitrogen-containing compound and from 10 to 90 wt. %, preferably from 25 to 75 wt. %, particularly preferably from 40 to 60 wt. %, of an oxidizing agent.

The invention claimed is:

1. Thermal pre-ignition agents having an adjustable deflagration point and a composition comprising from 10 to 50 wt. % dipicrylaminoethyl nitrate, from 25 to 75 wt. % of an oxidizing agent, and 10 to 60 wt. % of a nitrogen-containing compound other than dipicrylaminoethyl nitrate and the oxidizing agent, wherein the thermal pre-ignition agent has a deflagration point controlled based on the composition thereof.

2. Thermal pre-ignition agents according to claim 1, characterized in that the oxidizing agent is selected from one or more of the nitrates of the alkali and/or alkaline earth metals and/or of ammonium, of the perchlorates of the alkali and/or alkaline earth metals and/or of ammonium, and of the peroxides of the alkaline earth metals and/or of zinc.

3. Thermal pre-ignition agents according to claim 1, characterized in that the nitrogen-containing compound is selected from one or more of nitroguanidine, nitroaminoguanidine, nitrotriazolone, derivatives of tetrazole and/or salts thereof, nitraminotetrazole and/or its salts, aminoguanidine nitrate, diaminoguanidine nitrate, triaminoguanidine nitrate, guanidine nitrate, dicyandiamidine nitrate, and diaminoguanidine azotetrazolate.

4. Thermal pre-ignition agents according to claim 1, wherein the composition further comprises at least 1 wt. % of a reducing agent.

5. Thermal pre-ignition agents according to claim 1, wherein the composition further comprises at least 1 wt. % of a binder.

6. Thermal pre-ignition agents according to claim 1, wherein the composition further comprises at least 10 wt. % of at least one high-energy additive.

7. Thermal pre-ignition agents according to claim 1, wherein the composition further comprises from 0.1 to 20 wt. % of at least one combustion moderator and processing aid.

8. A thermal fuse for use in gas generators for motor vehicle safety systems, comprising a thermal pre-ignition agent according to claim 1.

9. Thermal pre-ignition agents according to claim 1, wherein the composition comprises from 10 to 30 wt. % of the dipicrylaminoethyl nitrate.

10. Thermal pre-ignition agents according to claim 1, wherein the composition comprises from 20 to 40 wt. % of the nitrogen-containing compound.

11. Thermal pre-ignition agents according to claim 4, wherein the composition comprises from 1 to 40 wt. % of the reducing agent.

12. Thermal pre-ignition agents according to claim 4, wherein the composition comprises from 1 to 15 wt. % of the reducing agent.

13. Thermal pre-ignition agents according to claim 4, wherein the reducing agent is selected from one or more of aluminum, titanium, titanium hydride, boron, boron hydride, zirconium, zirconium hydride, silicon, graphite, activated carbon, and carbon black.

14. Thermal pre-ignition agents according to claim 5, wherein the composition comprises from 1 to 40 wt. % of the binder.

15. Thermal pre-ignition agents according to claim 5, wherein the composition comprises from 1 to 20 wt. % of the binder.

16. Thermal pre-ignition agents according to claim 5, wherein the binder is selected from one or more of cellulose and derivatives thereof, polyvinylbutyrals, polynitropolyphenylene, polynitrophenyl ether, Plexigum, polyvinyl acetate and copolymers.

17. Thermal pre-ignition agents according to claim 6, wherein the composition comprises from 10 to 50 wt. % of the at least one high-energy additive.

18. Thermal pre-ignition agents according to claim 6, wherein the composition comprises from 10 to 30 wt. % of the at least one high-energy additive.

19. Thermal pre-ignition agents according to claim 6, wherein the at least one high-energy additive is selected from one or more of hexogen, octogen and nitrocellulose.

20. Thermal pre-ignition agents according to claim 7, wherein the composition comprises from 0.1 to 10 wt. % of the at least one combustion moderator and processing aid.

21. Thermal pre-ignition agents according to claim 7, wherein the at least one combustion moderator and processing aid is selected from one or more of ferrocene and derivatives thereof, acetonylacetates, salicylates, silicates, silica gels and boron nitride.

22. Thermal pre-ignition agents according to claim 1, wherein the composition has a deflagration point in a range of 178° C. to 208° C.

23. Thermal pre-ignition agents according to claim 22, wherein the composition has a deflagration point below 200° C.

24. A thermal pre-ignition agent composition consisting essentially of from 10 to 50 wt. % dipicrylaminoethyl nitrate, from 25 to 75 wt. % of an oxidizing agent, and 10 to 60 wt. % of a nitrogen-containing compound other than dipicrylaminoethyl nitrate and the oxidizing agent, wherein the thermal pre-ignition agent composition has a deflagration point in a range of 178° C. to 208° C.

25. A thermal pre-ignition agent composition consisting essentially of from 10 to 50 wt. % dipicrylaminoethyl nitrate, from 25 to 75 wt. % of an oxidizing agent, and 10 to 60 wt. % of a nitrogen-containing compound other than dipicrylaminoethyl nitrate and the oxidizing agent, and, optionally at least one additive selected from the group consisting of a reducing agent, a binder, a high-energy additive, and a combustion moderator and processing aid, wherein the thermal pre-ignition agent composition has a deflagration point in a range of 178° C. to 208° C.

26. The thermal pre-ignition agent composition according to claim 25, wherein the reducing agent is selected from the group consisting of aluminium, titanium, titanium hydride, boron, boron hydride, zirconium, zirconium hydride, silicon, graphite, activated carbon and carbon black, the binder is selected from the group consisting of cellulose and derivatives thereof, polyvinylbutyrals, polynitropolyphenylene, polynitrophenyl ether, Plexigum, polyvinyl acetate and copolymers thereof, the high-energy additive is selected from the group consisting of hexogen, octogen and nitrocellulose, and the combustion moderator and processing aid is selected from the group consisting of ferrocene and derivatives, acetonylacetates, salicylates, silicates, silica gels and boron nitride.

27. The thermal pre-ignition agent composition according to claim 25, wherein the composition has a deflagration point below 200° C.

28. A thermal fuse for use in gas generators for motor vehicle safety systems, comprising the thermal pre-ignition agent composition according to claim 27.

29. A thermal fuse for use in gas generators for motor vehicle safety systems, comprising the thermal pre-ignition agent composition according to claim 25.

* * * * *